United States Patent [19]

Munson et al.

[11] Patent Number: 4,864,320

[45] Date of Patent: Sep. 5, 1989

[54] MONOPOLE/L-SHAPED PARASITIC ELEMENTS FOR CIRCULARLY/ELLIPTICALLY POLARIZED WAVE TRANSCEIVING

[75] Inventors: Michael G. Munson; Robert E. Munson; Patrick M. Westfeldt, Jr., all of Boulder; Farzin Lalezari, Louisville, all of Colo.

[73] Assignee: Ball Corporation, Muncie, Ind.

[21] Appl. No.: 190,982

[22] Filed: May 6, 1988

[51] Int. Cl.[4] ..... H01Q 19/00

[52] U.S. Cl. ..... 343/833; 343/834; 343/829; 343/830; 343/846

[58] Field of Search ..... 343/833, 826, 828, 829, 343/830, 846, 848, 849, 711, 712, 713, 756, 799, 834

[56] References Cited

U.S. PATENT DOCUMENTS

| | | | |
|---|---|---|---|
| 2,026,652 | 1/1936 | Ponte | 343/848 |
| 2,928,087 | 3/1960 | Parker | 343/833 |
| 3,109,175 | 10/1963 | Lloyd | 343/833 |
| 3,560,978 | 2/1971 | Himmel et al. | 343/833 |
| 4,555,708 | 11/1985 | Waineo et al. | 343/799 |
| 4,631,546 | 12/1986 | Dumas et al. | 343/846 |
| 4,700,197 | 10/1987 | Milne | 343/846 |

*Primary Examiner*—Rolf Hille
*Assistant Examiner*—Hoanganh Le
*Attorney, Agent, or Firm*—Gilbert E. Alberding

[57] ABSTRACT

The subject invention relates to antennas having substantially greater bandwidth and low angle gain of the type for the transceiving of circularly/elliptically polarized electromagnetic waves. The antenna structure comprises a ground plane, a source of linearly-polarized wave energy field associated with said ground plane, and a plurality of conductive elements having an L-shape, said elements equally spaced from one another and equiangularly disposed about the sources, said plurality of elements being in a form of a circular arrangements, each element being so disposed as to fall on the circumference of the circular arrangement, each element lying in a common plane orthogonal to the linearly-polarized wave energy field provided by said source. The subject invention has special utility in motor and marine craft for communication and navigation.

24 Claims, 2 Drawing Sheets

FIG.3
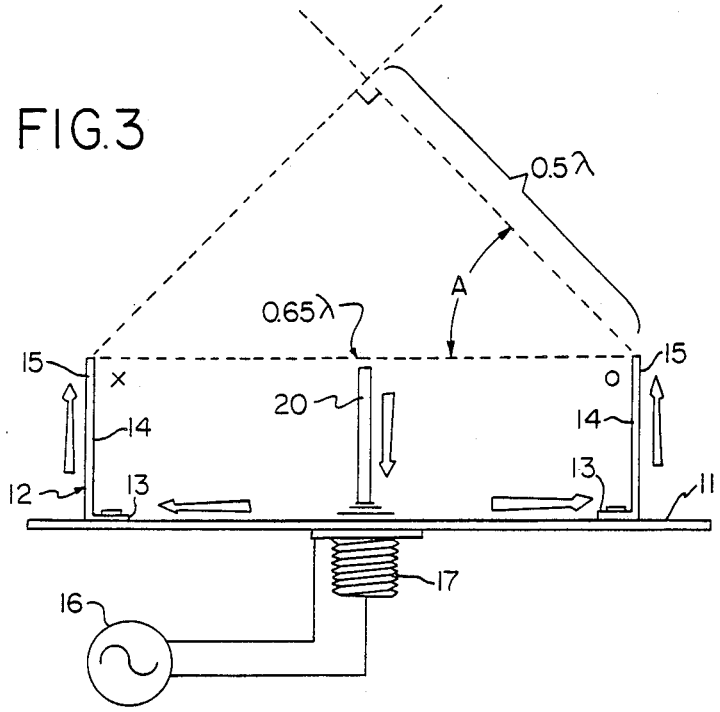
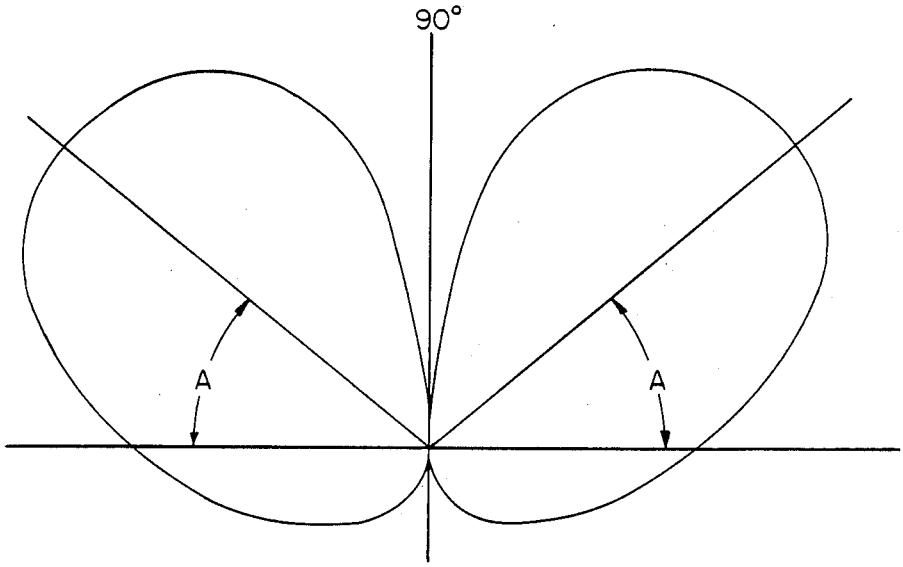
FIG.4

MONOPOLE/L-SHAPED PARASITIC ELEMENTS FOR CIRCULARLY/ELLIPTICALLY POLARIZED WAVE TRANSCEIVING

IELD OF THE INVENTION

This invention relates to antennas and more particularly it relates to antennas having substantially greater bandwidth and low angle gain of the type for the generation of circularly polarized annular radiation patterns.

DESCRIPTION OF THE PRIOR ART

In order to receive various electromagnetic waves such as broadcasted communicating waves of radio, television, telephone, etc., with high accuracy on a moving vehicle or vessel, such as an automobile, ship or aircraft, an antenna structure is required for the transmission and reception of such waves between the vehicle and a transceiving station. Such an antenna structure must be effectively designed with special care in order to properly handle various frequencies including microwave, radio, citizen's band, etc. In recent times the transceiving function has been greatly enhanced by artificial satellites, both active and passive, and their roles have substantially facilitated communication as well as navigation.

As for motorized vehicles, two general categories of antenna structures are commonly used: the windshield antenna and the mast antenna. In a windshield antenna, at least one conductor is embedded within the windshield structure of the vehicle and is therefore shielded from the weather, damage and vandalism. Because of the relative thinness of such a conductor, it is often susceptible to breaking or cracking and, due to its power handling capacity, is poorly suited in transmitting signals. More importantly, windshield antennas are susceptible to distortions, especially with respect to the direction of vehicle travel or orientation. In the mast antenna, a conductor, usually a whip-type or rod antenna projects outwardly from the vehicle body. The conventional vertical whip antenna typically is a monopole of about 0.3 to 3 meters in length. It is readily used because it is easy to construct and install on vehicles. The quarter-wavelength element is mechanically mounted to a part of the vehicle body, as the roof, hood or trunk. Although widely utilized, its resulting radiation pattern is not always readily predictable.

Although high frequency antenna structures have found rather wide use in military and industrial applications, the use of high frequency antennas in consumer applications has been far more limited, despite the fact that a great many consumers use high frequency radio communications every day. For example, cellular car radio telephones, which are becoming more and more popular and pervasive, could benefit from a low-profile, high frequency antenna radiating device if such a device could be conveniently housed on or in a motor vehicle and if it could provide sufficient bandwidth omni-directivity, low profile and, at the same time, be capable of effectively receiving and launching circular or elliptical polarized electromagnetic waves.

A rather basic form of antenna device proposed for motorized vehicles has been a helical structure, a wire conductor wound in the shape of a screw thread and used in conjunction with a ground plane. Although such antennas are relatively advantageous in handling high frequencies and provide proper field characteristics, such coiled antenna structures are highly prone to disruption, rupture or dislodgement due to misalignment and disorientation of the helical element that is usually brought on by the constant pounding and vibrations associated with vehicles and vessels on land and water.

SUMMARY OF THE INVENTION

There is a need for an antenna of simplistic design and low cost that can withstand substantial jarring and vibrations without disorientation and that can operate at the same time over a broadband of frequencies and provide a low profile radiation pattern.

An object of the present invention is to provide a sturdy antenna device having a low angle gain and broadband characteristics.

Another object of the present invention is to provide an antenna structure of novel design that can be easily manufactured and mass produced.

Another object of the present invention is to provide an antenna that can launch and receive circularly or elliptically polarized electromagnetic signals omnidirectionally.

A further object of this invention is to provide an improved transmitting and receiving antenna exhibiting a low azimuth plane gain and capable of radiating and receiving elliptically and circularly polarized wave energy omnidirectioally.

Another object of the subject invention is to provide an antenna that is suitable for installing on automobiles, trucks, tractor-trailer cabs, buses, fire trucks and other emergency vehicles including ambulances, as well as other motor craft types including marine crafts, such as boats and the like.

Still yet another object of the subject invention is to provide an improved antenna structure for mobile vehicles while eliminating fading, loss of reception and any other undesirable disruptions upon a change in direction often associated with conventional mobile antenna.

Still another object of the subject invention is to provide an antenna structure having a stable, long range pattern for mobile communication and navigation.

These together with other objects and advantages, which will become subsequently apparent, reside in the details of construction and operations as more fully hereinafter described and claimed, reference being had to the accompanying drawings forming a part hereof.

From a broad aspect, the foregoing objects are achieved in a combination of a source of linearly polarized electromagnetic wave energy and a plurality of L-shaped conductive antenna elements positioned to couple orthogonally to said source to provide reradiated polarization in phase quadrature and thereby afford circular polarization radiation in the far field. An important aspect of the subject invention is the particular geometry and arrangement of conducting and reradiating elements. In particular, the circular arrangement of the horizontal arms of the L-shaped elements are found to act as parasitic radiating antenna devices to provide a highly desirable radiation pattern having a low angle gain of circularly/elliptically polarized wave energy. The monopole portion of the antenna includes a ground plane dielectrically spaced from the monopole but so arranged as to be coupled therewith. It will be appreciated by those skilled in the art that the antenna structure here disclosed may be readily coupled to means for generating or receiving signals by conventional external circuits. Thus, a transmitter means may be readily applied to the antenna structure, the transmitter means comprising a means for generating a carrier radio frequency signal, and modulating said generated frequency with intelligence. The modulated radio frequency signal is fed to the antenna structure, the feeder device being properly matched to the antenna and the signal radiated or propagated into space by the antenna structure.

In accordance with the subject invention, the source of radiation is provided by a monopole structure situated above a ground plane to afford a first linearly-polarized radiated field. The antenna structure herein discloses comprises means for transceiving a first linearly-polarized radiated field, and a plurality of L-shaped conductive elements disposed about said transceiving means, each conductive element thereof having an arm spaced from and extending substantially parallel to a ground plane, each element being positioned orthogonal to the first linearly-polarized radiated field whereby the energy therefrom is coupled into each arm to reradiate a second linearly-polarized radiated field normal to said field and in phase quadrature with said first field to afford in combination with each other a circularly/elliptically polarized radiation pattern.

The subject invention comprises a ground plane, a source of linearly-polarized wave energy field situated adjacent thereto, and a plurality of conductive elements such as dipoles that are equally spaced from one another and are disposed equiangularly about said source, said plurality of conductive elements being formed in a circular arrangement, each element being so disposed as to fall on the circumference of the circular arrangement, each element lying in a common plane orthogonal to the linearly-polarized wave energy field provided by said source.

The subject invention substantially overcomes the shortcomings of the prior art in offering a rugged antenna without significant sacrifice in bandwidth, impedance, and radiation pattern, one having substantial low angle gain and efficiency. A close examination of the structural features of the subject invention as disclosure more fully hereinafter will reveal that the subject invention may be fabricated quickly, without difficulty and at nominal costs.

BRIEF DESCRIPTION OF THE DRAWINGS

FIG. 3 is a representative view in cross-section of the antenna of the subject invention; and FIG. 4 is a typical elevation radiation of the subject invention with a rotating linear source showing a peak of about 40 degrees above the horizon.

DETAILED DESCRIPTION OF A PREFERRED EMBODIMENT

Figure 1:
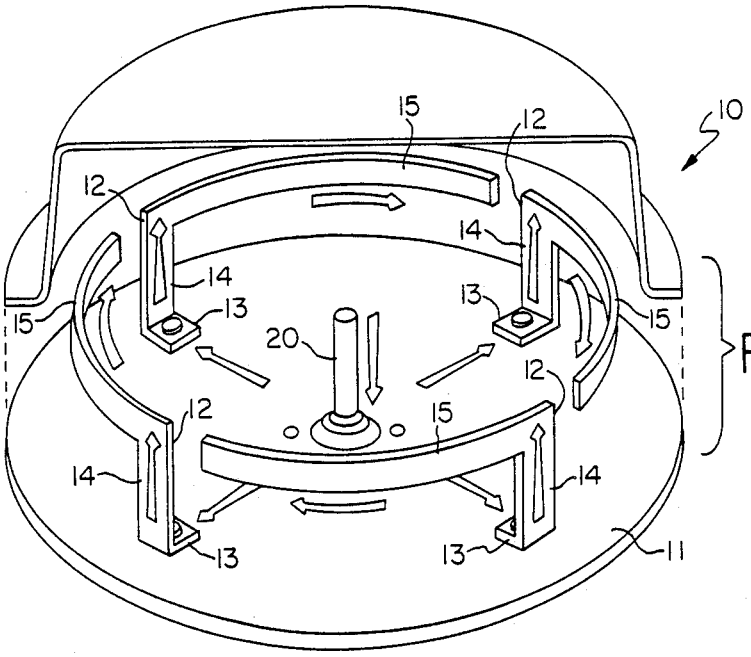
FIG. 1 is a schematic drawing showing the antenna of the subject invention.
Figure 2:
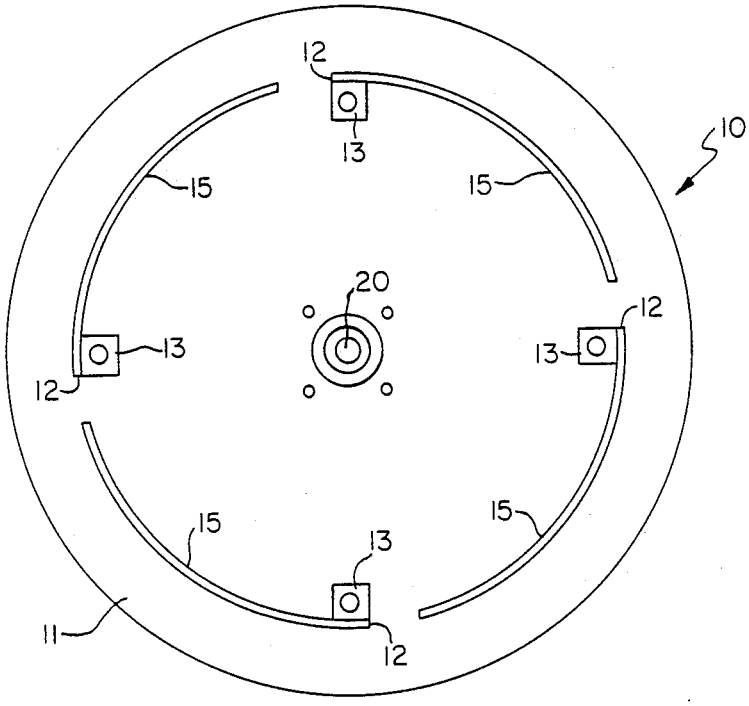
FIG. 2 is a top plane view of the antenna of the subject invention.

With reference to FIG. 1 of the drawings, a preferred embodiment of the full antenna structure 10 of the subject invention is schematically shown. It includes generally circular ground plane 11 which may be a metallized structure or board upon which electroplated copper or other conductive metal is deposited. The antenna structure 10 further comprises a plurality of L-shaped conductive elements 12 that are mounted to the ground plane 11 at their ends 13 by conventional means such as thread screws or rivets. It is noted that the ends 13 extend upwardly and away from the ground plane 11 in the form of an inverted L, with one branch or arm 14 extending vertically from the ground plane 11 and the other arm 15 extending parallel and spaced from the ground plane 11. It should also be noted that the direction of each arm 15 is uniform and curves substantially in a circular arrangement.

A monopole 20 extends from the ground plane 11, is orthogonal to said plane, and is insulated therefrom. The monopole 20, in a preferred embodiment of the subject invention, may be a quarter-wavelength radiator. As known, when such a vertical quarter-wavelength radiator is positioned with its base portion at or just above the ground plane, it can be considered to be imaged in the ground plane itself so that its radiation properties may be analyzed as if it were a half-wave dipole in free space. More importantly, when such a monopole element is fed at its base portion its radiation resistance and input impedance are just half the values for the half-wave dipole, its directivity is twice as great, and its polarization is linear.

As is known, the particular type of antenna structure used determines the initial polarization of electromagnetic waves. For example, dipole antennas render symmetrical radiation patterns when fed at their centers and give rise to linearly polarized waves, that is, the electric vector has a particular direction in space for all values of z, the direction of polarization. When the electric E-vector is vertical the wave is referred to as being vertically polarized and if the electric E-vector lies in a horizontal plane, the wave is referred to as being horizontally polarized. It is common practice to describe polarization in terms of the E-vector, and in the design of any antenna, it is important that the type of polarization desired be considered for a large number of applications since reception and transmission is best when there is matching of the electromagnetic directional or orientational characteristics.

In the field of communication and navigation circularly and elliptically polarized electromagnetic waves are widely used., A circularly polarized wave results when two linearly polarized waves are combined, provided the linearly polarized waves are launched in the same direction and are at right angles to each other and their phase angles differ by 90 degrees or II/2 radians. In circular polarization the E-vector rotates with time about the z-axis so that the wave advances in a helical fashion. When the phase difference between the two linearly polarized components are equal in amplitude conditions are such that circular polarization is formed. However, if there are different amplitudes for the linearly polarized waves elliptical polarization is produced the right-hand or left-hand rotation of the combination depending upon whether the phase difference is plus or minus.

The L-shaped conductive elements 12 of the subject invention serve as parasitic reradiating elements to provide a horizontally-polarized component. To establish circular polarization the vertical and horizontal fields should be in phase quadrature and this particular phase difference, in accordance with the subject invention, is achieved by the monopole element being allowed to directly launch a vertical field component and reradiating a horizontal component to the field from the reactance of the plurality of L-shaped conductive elements that are associated in equiangular arrangement about the monopole element. Thus, the first of the orthogonal polarized vectors is a vertically-polarized vector as launched by the monopole element itself and the second of the orthogonal polarized vectors is a summation of the horizontally-polarized vector that is produced by reradiation from the L-shaped conductive elements and the vertically-polarized vector which achieve together and in phase quardrature a circularly polarized radiation pattern.

In a preferred embodiment the L-shaped conductive elements are spaced from a one-quarter wavelength monopole by above 0.33λ, such that the delayed electromagnetic wave energy, parasitically coupled and reradiated from the horizontal arms of L-shaped conductive elements effect a horizontal component to be in phase quadrature to an initial, vertically-polarized electromagnetic wave energy radiated by the one-quarter wavelength monopole and in proper phase as compared to the opposite L-shaped conductive element (i.e., the horizontal arm thereof) to afford the elliptically and/or circularly polarized radiation pattern.

Viewing the antenna structure from overhead it can be appreciated that electrical current flowing in each L-shaped conductive element flows at the same instant in a direction opposite from the element directly across therefrom, thus causing a null as would be provided by a monopole radiation pattern. Further, in viewing a section through the antenna structure as shown in FIG. 3, the two horizontal conductive arms of the conductive elements may be treated as dipoles spaced about 0.4λover a ground plane. It will be appreciated by those skilled in the art that the particular shaping employed would cause the peak of the radiation pattern that is afforded by an array of two such conductive elements to occur (by constructive interference) at about 40 degrees above the horizon, again matching a radiation pattern of a vertically-polarized monopole. Note FIG. 4 which shows H-plane pattern of the array of FIG. 3. Moreover, it can be appreciated that the diameter selected determines the position of the peak (assuming identical conductive elements) and therefore, the only remaining independent variable that is left to consider for phase quadrature is the horizontal length of the L-shaped conductive element. Generally, this length is usually about 0.4λ. Parenthetically, this length may be reduced to some extent without loss of circular polarization, however, there is some decrease in gain. As for the vertical length of the arm, it can be readily adjusted to couple energy parasitically from the monopole element and associated ground plane current into the L-shaped elements with a magnitude generally equal to the amount radiated by the monopole element.

An important structural feature of the subject invention is the particular circular arrangement of the horizontal screen of the L-shaped elements. In particular, they are equally spaced from one another and are oriented to fall on or define the circumference of a great circle as viewed from above. The arms extend outwardly from the vertical arms of the L-shaped element, the plurality of conductive elements being curved to conform to the great circle and are equiangularly disposed around a center point or axis thereof that serves as the launching site of the initial linear-polarized wave energy. In arms themselves may be round in cross-sectional geometry, or they may be of any other shape, and as square or rectangular.

Although the ground plane is shown to be planar or flat-like in form, it is understood that it may be curved as, for example, it could be domed upwardly. In one embodiment the ground plane may take the form of a truncated cone in which the L-shaped conductive elements are equally placed and equiangularly disposed about the central axis of the cone. Thus, the conical ground plane could be readily employed in the fashion of a disc-cone antenna to provide the peak of the vertical polarization closer to the horizon, in which case the L-shaped element would be spaced closer to initial radiating source by about 0.5λ. In such a configuration the antenna structure would provide an elliptically polarized pattern similar to that of a discone radiation pattern.

It will be noted that the monopole 12 is coupled to a coaxial cable 17 which in turn serves to supply means for generating signals by a conventional circuit 16.

It is understood that although the means for supplying the linearly-polarized wave energy is preferable a monopole, it can be appreciated that other sources of such energy may also be utilized. For example, a waveguide provided with an equal distribution of longitudinal slots would radiate horizontally-polarized wave energy and, thus, be an initial source of linearly-polarized wave energy.

There are various changes and modifications which may be made to the invention as would be apparent to those skilled in the art. Although the ground plane, for example, is described as being round or circular in shape for ease of manufacture and design the ground plane may be configured in other shapes, if desired, such as square, rectangular or other polygonal forms. Further, the L-shaped conductive elements surrounding the monopole could be positioned at midpoints or corners of such polygonal forms or could, if desired, as well be symmetrically arranged thereon. Further, although the upper L-shaped conductor elements are shown generally as curved members, that is having curved arms that coincide with arcs of a circle about the monopole, such arms need not be curved, e.g., they may be linear or unbent and equally disposed from the monopole. Further, the antenna input impedance may be increased by using a folded monopole, if desired. It will also be appreciated by those skilled in the art that the entire antenna device once mounted to a vehicle would be subjected to substantial vibrations as well as exposure to atmospheric elements, i.e., wind, rain, sleet and snow, and, therefore, needs to be readily housed or covered with a protective radome, as for example ABS resin or the like, and the interior of the housing, in accordance with standard practice, may be filled with a conventional foam or combination of foams to render the antenna structure more reliable and rugged, and, therefore, not to cause disruption and misalignment of said structure. However, any of these changes of modifications are included in the teaching of the disclosure and it is intended that the invention be limited only by the scope of the claims appended hereto.

We claim:

1. An antenna structure capable of radiating and receiving circularly polarized electromagnetic waves comprising means for transceiving a first linearly-polarized radiated field, a plurality of L-shaped conductive elements disposed about said transceiving means, each L-shaped conductive element having an arm spaced from and extending substantially parallel to a ground plane and positioned orthogonal to the first linearly-polarized radiated field, each L-shaped conductive element being positioned to receive the field from the transceiving means and to reradiate a second linearly-polaized radiated field normal to said first field and in phase quadrature with said first field to afford in combination with each other a circularly polarized radiation pattern.

2. An antenna structure as recited in claim 1 wherein said transceiving means is a monopole.

3. An antenna structure as recited in claim 2 wherein the monopole is one-quarter of the wavelength of the frequency used by the antenna.

4. An antenna structure as recited in claim 3 wherein the plurality of L-shaped conductive elements is spaced from the monopole by about 0.3λ.

5. An antenna structure as recited in claim 1 wherein the length of each arm positioned parallel to the ground plane is about 0.4λ.

6. An antenna structure as recited in claim 1 which further includes means for connecting said transceiving means and said ground plane to an external circuit.

7. An antenna structure as recited in claim 6 in which said connecting means comprises a coaxial cable having an inner conductor and an outer conductor coaxially positioned around said inner conductor, and wherein said inner conductor is connected to said transceiving means and said outer conductor is connected to said ground plane.

8. An antenna structure comprising a ground plane, a source of linear polarized electromagnetic waves situated adjacent said ground plane, and a plurality of L-shaped antenna elements spaced from and positioned to receive said electromagnetic waves from said source, one arm of each L-shaped antenna element being connected to said ground plane and the other arm of each L-shaped antenna element being equiangularly disposed about said source and positioned normal to the linear polarized electromagnetic waves.

9. An antenna structure as recited in claim 8 wherein the source of linear polarized electromagnetic waves is a monopole.

10. An antenna structure comprising a monopole antenna, a ground plane disposed orthogonally to said monopole antenna, a plurality of elements having two interconnected arms, with their first arms being connected at their free ends to the ground plane and their second arms having their free ends disposed above the ground plane and parallel thereto, said second free ends extending in a uniform direction and equiangularly disposed from the monopole.

11. An antenna structure as recited in claim 10 wherein the monopole is one-quarter of the wavelength of the frequency used by the antenna.

12. An antenna structure as recited in claim 10 wherein the plurality of elements is spaced from the monopole by at least about 0.3λ.

13. An antenna structure as recited in claim 10 which further includes means for connecting said monopole and said ground plane to an external circuit.

14. An antenna structure as recited in claim 13 in which said connecting means comprises a coaxial cable having an outer conductor coaxially positioned around an inner conductor, and wherein said inner conductor is connected to said monopole and said outer conductor is connected to said ground pole.

15. An antenna structure comprising a ground plane, a source of a linearly-polarized wave energy field situated adjacent said ground plane, and a plurality of parasitic elements equally spaced from one another and equiangularly disposed about said source, said plurality of parasitic elements being in a form of a circular arrangement, each parasitic element being so disposed as to fall on the circumference of the circular arrangement, each parasitic element having a portion lying in a common plane orthogonal to the linearly-polarized wave energy field provided by said source to generate a second linearly-polarized wave component orthogonal to the linearly polarized wave energy provided by said source.

16. An antenna structure as recited in claim 15 wherein the source of linearly-polarized wave energy field is a monopole.

17. An antenna structure as recited in claim 16 wherein the monopole is one-quarter of the wavelength of the frequency used by the antenna.

18. An antenna structure as recited in claim 15 wherein the plurality of parasitic elements are L-shaped elements and spaced from the source, said L-shaped elements being coupled to the energy field from said source to reradiate said second linearly-polarized wave component normal to said first field and in phase quadrature with said first field to afford in combination with each other a circularly/elliptically polarized wave pattern.

19. An antenna structure as recited in claim 15 wherein there are two parasitic elements.

20. An antenna structure as recited in claim 15 when there are four parasitic elements.

21. An antenna structure as recited in claim 15 which further includes means for connecting said source and said ground plane to a modulated radio frequency signal.

22. An antenna structure as recited in claim 21 in which said connecting means comprises a coaxial cable.

23. An antenna structure as recited in claim 15 wherein the source of linearly-polarized wave energy is a waveguide provided with slots that propagate said energy therefrom.

24. An antenna structure as recited in claim 15 wherein at least one parasitic element has a corresponding parasitic element directly across therefrom and having its terminal end facing in a direction opposite to that of the other.

* * * * *